US011705679B2

(12) United States Patent
Theunissen

(10) Patent No.: US 11,705,679 B2
(45) Date of Patent: Jul. 18, 2023

(54) IN-LINE MODULAR INDICATOR ASSEMBLY

(71) Applicant: Banner Engineering Corp., Minneapolis, MN (US)

(72) Inventor: William Theunissen, Maple Grove, MN (US)

(73) Assignee: Banner Engineering Corp., Minneapolis, MN (US)

( * ) Notice: Subject to any disclaimer, the term of this patent is extended or adjusted under 35 U.S.C. 154(b) by 0 days.

(21) Appl. No.: 17/324,694

(22) Filed: May 19, 2021

(65) Prior Publication Data

US 2022/0200215 A1 Jun. 23, 2022

Related U.S. Application Data

(60) Provisional application No. 63/127,284, filed on Dec. 18, 2020.

(51) Int. Cl.
*H01R 13/717* (2006.01)
*H01R 13/621* (2006.01)

(52) U.S. Cl.
CPC ..... *H01R 13/717* (2013.01); *H01R 13/621* (2013.01)

(58) Field of Classification Search
CPC ..... H01R 13/717; H01R 13/621; G09F 13/22; G09F 13/04; G08B 5/00
See application file for complete search history.

(56) References Cited

U.S. PATENT DOCUMENTS 5,172,098 A * 12/1992 Leyden ..... G08B 13/1454 340/568.4
5,244,409 A 9/1993 Guss, III et al.
5,359,290 A 10/1994 Cervas
5,644,462 A 7/1997 Boschetto et al.
5,885,109 A * 3/1999 Lee ..... H01R 31/065 439/652
5,952,915 A 9/1999 Marquardt et al.
6,437,580 B1 8/2002 Gale
6,975,209 B2 12/2005 Gromov
6,997,576 B1 2/2006 Lodhie et al.
(Continued)

FOREIGN PATENT DOCUMENTS

EP 3 263 971 A1 1/2018
WO WO-9707568 A1 * 2/1997 ..... H01R 13/7137

OTHER PUBLICATIONS

Grace Engineered Products, Inc., Permanent Electrical Safety Devices (PESDs), Aug. 2014, Grace Engineered Products, Inc., Davenport, IA.

(Continued)

*Primary Examiner* — Travis S Chambers
(74) *Attorney, Agent, or Firm* — Mueting Raasch Group

(57) ABSTRACT

The current technology relates to an in-line modular indicator assembly. Each of a plurality of in-line modular indicators are configured to be coupled in a series with a first electrical cable and a second electrical cable. The plurality of in-line modular indicators is configured to define an electrically conductive path to transmit electricity from the first electrical cable to the second electrical cable. Each of the in-line modular indicators have detection circuits having alternate configurations and notification devices configured to provide alternate notifications.

18 Claims, 4 Drawing Sheets

(56) References Cited

U.S. PATENT DOCUMENTS

| | | | |
|---|---|---|---|
| 7,052,171 | B1 | 5/2006 | Lefebvre et al. |
| 7,375,533 | B2 | 5/2008 | Gale |
| 7,581,982 | B2 | 9/2009 | Mehnert et al. |
| 7,633,298 | B1 | 12/2009 | Kan et al. |
| 7,738,787 | B2 | 6/2010 | Nakajima et al. |
| 7,816,925 | B1 | 10/2010 | Gale |
| 8,147,758 | B2 | 4/2012 | Leach |
| 9,052,350 | B2 | 6/2015 | Neti et al. |
| 9,410,988 | B2 | 8/2016 | Zavis |
| 9,812,821 | B2 | 11/2017 | Hagemeier et al. |
| 10,347,092 | B2 | 7/2019 | Dolezalek et al. |
| 10,475,304 | B2 | 11/2019 | Auer et al. |
| 2004/0166743 | A1 | 8/2004 | Kurose et al. |
| 2009/0023329 | A1 | 1/2009 | Mehnert et al. |
| 2010/0109900 | A1 | 5/2010 | Marquardt et al. |
| 2010/0219344 | A1 | 9/2010 | Duckworth et al. |
| 2010/0231910 | A1 | 9/2010 | Mavliev |
| 2014/0193998 | A1* | 7/2014 | Zomchek ..... H01R 31/005 439/488 |
| 2014/0210631 | A1 | 7/2014 | Zavis |
| 2015/0109802 | A1 | 4/2015 | Chang et al. |
| 2015/0253362 | A1 | 9/2015 | Louzir et al. |
| 2015/0276140 | A1 | 10/2015 | Demuynck et al. |
| 2015/0372432 | A1 | 12/2015 | Hagemeier et al. |
| 2016/0327227 | A1 | 11/2016 | Green, Jr. et al. |
| 2017/0138574 | A1 | 5/2017 | Garcia et al. |
| 2018/0033260 | A1* | 2/2018 | Dolezalek ..... H01R 13/6683 |
| 2018/0102632 | A1* | 4/2018 | Byrne ..... H01R 13/5219 |
| 2018/0142864 | A1 | 5/2018 | Freyermuth et al. |
| 2019/0325714 | A1 | 10/2019 | Rosenberg et al. |

OTHER PUBLICATIONS

International Patent Application No. PCT/US2021/033402 filed May 20, 2021, PCT International Search Report and Written Opinion dated Sep. 24, 2021, 11 pages.

* cited by examiner

IN-LINE MODULAR INDICATOR ASSEMBLY

The present application claims priority to U.S. Provisional Patent Application No. 63/127,284, filed Dec. 18, 2020, the disclosure of which is incorporated by reference herein in its entirety.

TECHNOLOGICAL FIELD

The present disclosure is generally related to an indicator system. More particularly, the present disclosure is related to an in-line modular indicator system.

BACKGROUND

Indicator devices such as tower lights, are common in various environments such as manufacturing environments. Typically such indicator devices are used to communicate a system operating condition to users who are not able to immediately observe the system. For example, warning lights or alarms can be used to let users know that an operating condition is unsafe or that a corrective action needs to be taken. Indicator devices can also be used to communicate that a system is operating as expected.

SUMMARY

In-line modular indicator assemblies consistent with the technology disclosed herein are configured to be positioned in-line with the electrical cable of an outside system. The indicator assembly is configured to tap into power that was already being transmitted through the electrical cable to operate the outside system. Such a configuration simplifies the overall indicator assembly because separate electrical cables and mounting structures are not required for operation. Furthermore, the in-line modular indicator assemblies disclosed herein have a plurality of in-line modular indicators that are configured to be arranged in a series with outside system electrical cables. Each in-line modular indicator has differing circuitry configured to detect different operating conditions and provide different notifications. As such, a user may advantageously be made aware of a variety of different operating conditions that may be happening simultaneously. Furthermore, the relatively small size of the in-line modular indicators disclosed herein advantageously allows the assembly to be used in environments where space is at a premium.

The technology disclosed herein relates to, in part, an in-line modular indicator assembly. A first in-line modular indicator has a first releasable electrical interface configured to releasably couple to an electrical cable. A first mating electrical interface has a structure capable of mating with the first releasable electrical interface. A first electrically conductive path extends from the first releasable electrical interface to the first mating electrical interface. A first detection circuit is in electrical communication with the first electrically conductive path, where the first detection circuit is configured to detect a first signal. A first notification device is configured to provide a first notification upon detection of the first signal. The assembly has a second in-line modular indicator having a second releasable electrical interface. The second releasable electrical interface is configured to releasably couple to the first mating electrical interface. The second in-line modular indicator has a second mating electrical interface that is configured to releasably couple with the first releasable electrical interface. A second electrically conductive path extends from the second releasable electrical interface to the second mating electrical interface. A second detection circuit is in electrical communication with the second electrically conductive path, where the second detection circuit is configured to detect a second signal that is different than the first signal. A second notification device is configured to provide a second notification upon detection of the second signal, where the second notification is different from the first notification.

In some such embodiments, the first notification device is an illumination device. In some such embodiments, the illumination device is configured to emit light radially from a central axis of the first in-line modular indicator. Additionally or alternatively, the first notification device is an audio device. Additionally or alternatively, the first releasable electrical interface has a first mechanical connector dimension of less that 30 mm. Additionally or alternatively, the first releasable electrical interface has a first mechanical connector dimension ranging from 4 mm to 26 mm. Additionally or alternatively, the first notification device is a first illumination device configured to illuminate a first color and the second notification device is a second illumination device configured to illuminate a second color. Additionally or alternatively, the first notification and the second notification device have a length ranging from 5 mm to 150 mm. Additionally or alternatively, the first notification and the second notification device have a maximum width dimension ranging from 5 mm to 30 mm.

Some aspects of the current technology relate to an in-line modular indicator assembly. Each of a plurality of in-line modular indicators are configured to be coupled in a series with a first electrical cable and a second electrical cable. The plurality of in-line modular indicators is configured to define an electrically conductive path to transmit electricity from the first electrical cable to the second electrical cable. Each of the in-line modular indicators have detection circuits having alternate configurations and notification devices configured to provide alternate notifications.

In some such embodiments, each in-line modular indicator of the plurality of in-line modular indicators has a releasable electrical interface and a mating electrical interface, where the mating electrical interface is structured to releasably couple to the releasable electrical interface. Additionally or alternatively, at least one in-line modular indicator of the plurality of in-line modular indicators is an audio device. Additionally or alternatively, at least one in-line modular indicator of the plurality of in-line modular indicators is an illumination device. Additionally or alternatively, the illumination device is configured to emit light radially from a central axis of the at least one in-line modular indicator. Additionally or alternatively, each releasable electrical interface has a mechanical connector dimension of less than 30 mm.

Additionally or alternatively, each releasable electrical interface has a mechanical connector dimension ranging from 4 mm to 26 mm. Additionally or alternatively, the notification devices include a first notification device having a first illumination device configured to illuminate a first color and a second notification device having a second illumination device configured to illuminate a second color. Additionally or alternatively, the notification devices each have a length ranging from 5 mm to 150 mm. Additionally or alternatively, the notification devices each have a maximum width dimension ranging from 5 mm to 30 mm.

The above summary is not intended to describe each embodiment or every implementation. Rather, a more complete understanding of illustrative embodiments will become apparent and appreciated by reference to the following Detailed Description of Exemplary Embodiments and claims in view of the accompanying figures of the drawing.

Figure 1:
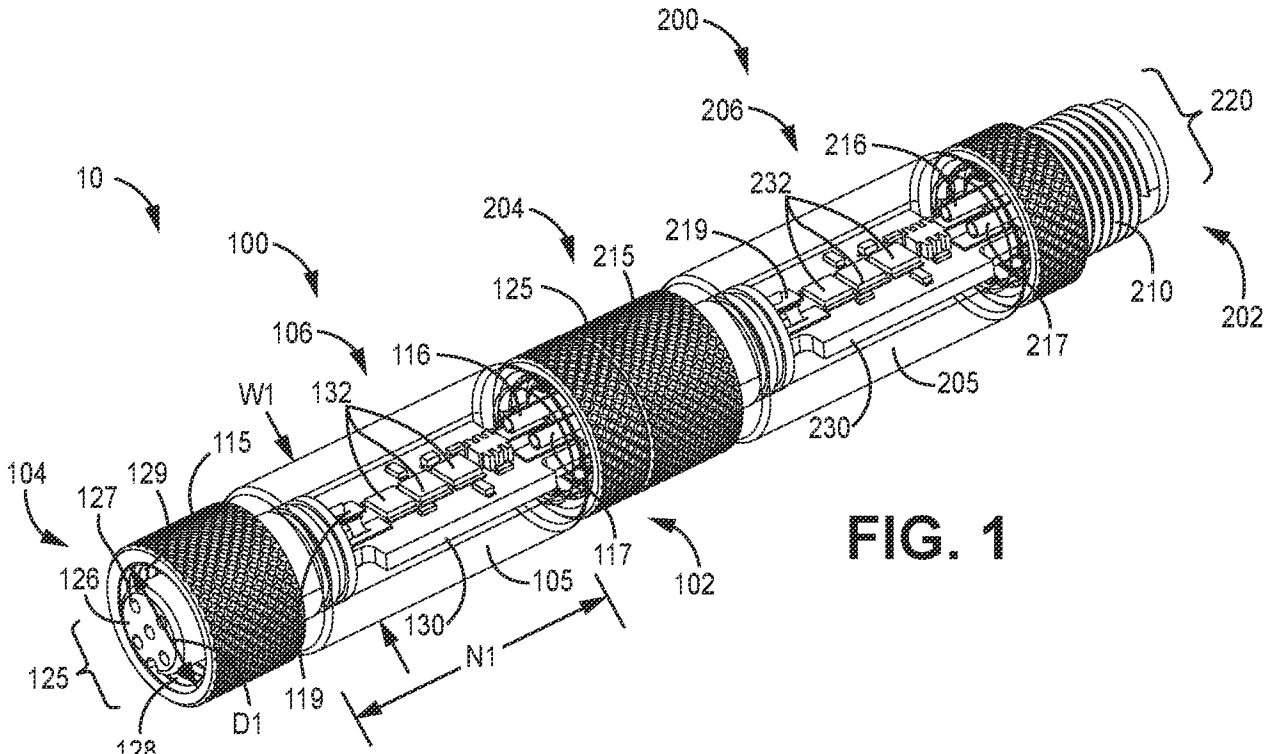
FIG. 1 is an example in-line indicator assembly consistent with embodiments.

The present technology may be more completely understood and appreciated in consideration of the following detailed description of various embodiments in connection with the accompanying drawings.

The figures are rendered primarily for clarity and, as a result, are not necessarily drawn to scale. Moreover, various structure/components, including but not limited to fasteners, electrical components (wiring, cables, etc.), and the like, may be shown diagrammatically or removed from some or all of the views to better illustrate aspects of the depicted embodiments, or where inclusion of such structure/components is not necessary to an understanding of the various exemplary embodiments described herein. The lack of illustration/description of such structure/components in a particular figure is, however, not to be interpreted as limiting the scope of the various embodiments in any way.

DETAILED DESCRIPTION

The technology disclosed herein relates to, in part, an in-line modular indicator assembly. A first in-line modular indicator has a first releasable electrical interface configured to releasably couple to an electrical cable. A first mating electrical interface has a structure capable of mating with the first releasable electrical interface. A first electrically conductive path extends from the first releasable electrical interface to the first mating electrical interface. A first detection circuit is in electrical communication with the first electrically conductive path, where the first detection circuit is configured to detect a first signal. A first notification device is configured to provide a first notification upon detection of the first signal. The assembly has a second in-line modular indicator having a second releasable electrical interface. The second releasable electrical interface is configured to releasably couple to the first mating electrical interface. The second in-line modular indicator has a second mating electrical interface that is configured to releasably couple with the first releasable electrical interface. A second electrically conductive path extends from the second releasable electrical interface to the second mating electrical interface. A second detection circuit is in electrical communication with the second electrically conductive path, where the second detection circuit is configured to detect a second signal that is different than the first signal. A second notification device is configured to provide a second notification upon detection of the second signal, where the second notification is different from the first notification.

In some such embodiments, the first notification device is an illumination device. In some such embodiments, the illumination device is configured to emit light radially from a central axis of the first in-line modular indicator. Additionally or alternatively, the first notification device is an audio device. Additionally or alternatively, the first releasable electrical interface has a first mechanical connector dimension of less that 30 mm. Additionally or alternatively, the first releasable electrical interface has a first mechanical connector dimension ranging from 4 mm to 26 mm. Additionally or alternatively, the first notification device is a first illumination device configured to illuminate a first color and the second notification device is a second illumination device configured to illuminate a second color. Additionally or alternatively, the first notification and the second notification device have a length ranging from 5 mm to 150 mm. Additionally or alternatively, the first notification and the second notification device have a maximum width dimension ranging from 5 mm to 30 mm.

Some aspects of the current technology relate to an in-line modular indicator assembly. Each of a plurality of in-line modular indicators are configured to be coupled in a series with a first electrical cable and a second electrical cable. The plurality of in-line modular indicators is configured to define an electrically conductive path to transmit electricity from the first electrical cable to the second electrical cable. Each of the in-line modular indicators have detection circuits having alternate configurations and notification devices configured to provide alternate notifications.

In some such embodiments, each in-line modular indicator of the plurality of in-line modular indicators has a releasable electrical interface and a mating electrical interface, where the mating electrical interface is structured to releasably couple to the releasable electrical interface. Additionally or alternatively, at least one in-line modular indicator of the plurality of in-line modular indicators is an audio device. Additionally or alternatively, at least one in-line modular indicator of the plurality of in-line modular indicators is an illumination device. Additionally or alternatively, the illumination device is configured to emit light radially from a central axis of the at least one in-line modular indicator. Additionally or alternatively, each releasable electrical interface has a mechanical connector dimension of less than 30 mm.

Additionally or alternatively, each releasable electrical interface has a mechanical connector dimension ranging from 4 mm to 26 mm. Additionally or alternatively, the notification devices include a first notification device having a first illumination device configured to illuminate a first color and a second notification device having a second illumination device configured to illuminate a second color. Additionally or alternatively, the notification devices each have a length ranging from 5 mm to 150 mm. Additionally or alternatively, the notification devices each have a maximum width dimension ranging from 5 mm to 30 mm.

Figure 2:
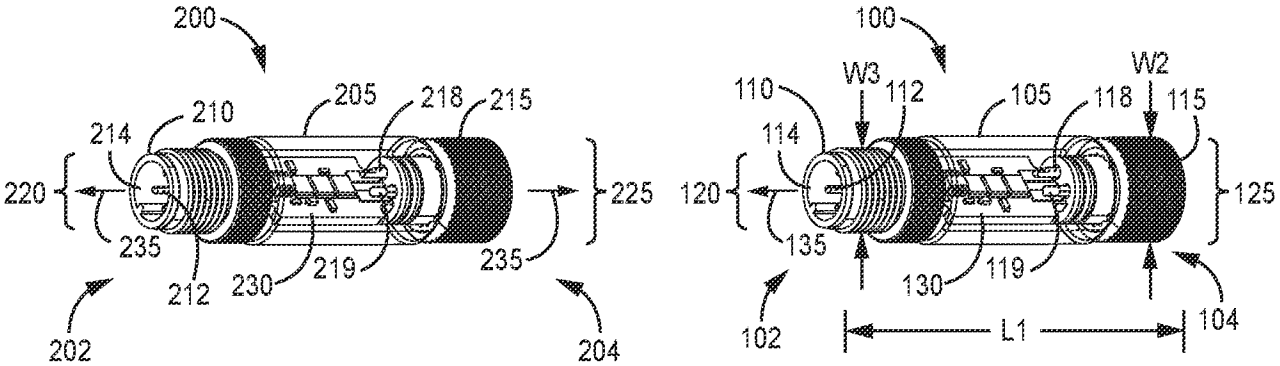
FIG. 2 is an exploded view of the in-line indicator assembly of FIG. 1.

FIG. 1 depicts an example in-line modular indicator assembly 10 consistent with various embodiments, and FIG. 2 depicts an exploded view of the assembly 10 of FIG. 1. The assembly 10 has a plurality of in-line modular indicators. The in-line modular indicators 100, 200 are configured to be coupled in series with a first electrical cable and a second electrical cable (not currently shown). The plurality of in-line modular indicators 100, 200 are configured to define an electrically conductive path to transmit electricity there through. The in-line modular indicators 100, 200 each have detection circuits 130, 230 having alternate configurations and notification devices 106, 206 configured to provide alternate notifications.

The assembly 10 has a first in-line modular indicator 100 and a second in-line modular indicator 200. The first in-line modular indicator 100 can have a length L1 (FIG. 2) generally ranging from 5 mm to 150 mm. The length L1 is generally measured along a first axis 135 that is central to the in-line modular indicator 100. In some embodiments first in-line modular indicator 100 can have a length L1 ranging from 20 mm to 100 mm. The first in-line modular indicator 100 can have a maximum width dimension W1, W2 (FIGS. 1 & 2 show example maximum width dimensions W1, W2) that is generally less than 31 mm, where the maximum width dimension W1, W2 is a maximum dimension across the first in-line modular indicator 100 in an imaginary plane perpendicular to the first axis 135. In the current example, where first in-line modular indicator 100 is generally cylindrical in shape, the maximum width dimension W1, W2 is a maximum diameter of the first in-line modular indicator 100. Where the first in-line modular indicator has an alternate shape, the maximum width dimension can be a maximum diagonal measurement. In some embodiments, the maximum width dimension W1, W2 ranges from 5 mm to 30 mm. The second in-line modular indicator 200 and other in-line modular indicators in the assembly can be consistent with these general dimensions, in some embodiments.

Each of the in-line modular indicators 100, 200 define an electrically conductive path from a releasable electrical interface 120, 220 on a first end 102, 202 of the indicator to a mating electrical interface 125 on a second end 104, 204 of the indicator. The electrically conductive paths are configured to be in electrical communication when the indicators 100, 200 are coupled. Each releasable electrical interface 120, 220 is structured to releasably mate with each mating electrical interface 125, 225. Additionally, each releasable electrical interface 120, 220 and each mating electrical interface 125, 225 is configured form an electrical and mechanical connection to one end of a corresponding electrical cable. As such, the in-line modular indicators 100, 200 are advantageously structured to be configurable to a variety of operating environments.

Each detection circuit 130, 230 is configured to be in electrical communication with the electrically conductive path through the indicator 100, 200. Detection circuits 130, 230 are generally configured to detect an operating status of a connected electrical device. For example, a detection circuit can be configured to determine whether a connected electrical device is powered on and operational. As another example, a detection circuit can be configured to determine whether a system condition is met, such as threshold criteria such time lapse, temperature, distance from an object, and the like. Each detection circuit 130, 230 is configured to detect a different pre-determined signal. In some embodiments, each detection circuit 130, 230 can be configured to detect two different signals. The detection circuits 130, 230 generally have alternate configurations, meaning that the detection circuits 130, 230 are configured to detect different signals. For example, a first detection circuit 130 is configured to detect a first signal and a second detection circuit 230 is configured to detect a second signal, where the first signal and second signal are different. Such a configuration advantageously allows the assembly 10 to monitor multiple signals across the electrically conductive path.

In some embodiments, the electrically conductive path through each detection circuit 130, 230 can be defined by a plurality of wires that each define a separate electrical pathway between the first end 102, 202 and the second end 104, 204 of the indicator 100, 200. In various embodiments, each wire can be configured to receive a separate signal from one or more of the remaining wires. For example, each wire can be configured to conduct a predetermined type of electrical signal such as AC power, DC power, digital, analog, differential, or single-ended. In various embodiments, each detection circuit 130, 230 is in electrical communication with a specific wire of the plurality of wires. Such configurations will be described in more detail, below.

By way of example and not limitation, the detection circuits 130, 230 can employ analog or digital circuitry, which can include active circuitry, passive circuitry, or both active and passive circuitry, for signal detection. Detection circuits consistent with the technology disclosed herein can detect a variety of types of signals. In some examples, a signal is a voltage or current between two inputs along the electrically conductive path. In some examples, a signal is an output from a sensor such as a proximity sensor, photoelectric sensor, thermal sensor, ultrasonic sensor, radar sensor, or another type of sensor. In some examples, the signal is based on a current along the electrically conductive path, or a calculation of a real or imaginary voltage or current amplitude or phase parameter. In some examples, the signal is based on two or more inputs, such as a summation of multiple currents to determine a total current, for example. In some examples, the signal may be based on the detection of a phase shift between two selected signals (e.g., voltage or current) falling within a predetermined limit or within a predetermined range.

A detection circuit can be configured to evaluate signals against predetermined criteria using circuit elements that may include, but are not limited to, phase detectors, amplitude detectors, attenuators, high pass filters (e.g., AC-coupling), low pass filters, band-pass filters, notch filters, frequency detectors (e.g., phase-locked loops), digital counters, analog-to-digital conversion stages, amplifiers, rectifiers, multipliers, alone or in combination, for example. Constant current circuits (e.g., current mirrors), and voltage threshold detectors may be employed in the detection module, which may advantageously minimize power drain on the signal path(s) being monitored, for example. In some implementations, a programmed processor (e.g., ASIC, microcontroller) may monitor and analyze signals. In some such embodiments, the programmed processor can be configured to generate and provide the control signals to a notification device 106, 206 in response to the signal detected by the detection circuit.

In some implementations, the detection circuit is programmable to receive updates to one or more previously programmed signal thresholds, or predetermined signal criteria, for example. In some examples, the detection circuit may be subject to entering a programming state upon stimulating selected inputs with a programming mode activation key sequence. For example, a programmable resistor may be reprogrammed in situ to repurpose the detection circuit for use with a new application that illuminates in response to a different signal. In some embodiments, the detection circuit may be programmable (or readable) by wired or wireless (e.g., optical, electromagnetic field) communication through the housing or overmolding, for example. It is noted that the housing or overmolding can have varying degrees of opacity and transparency.

The notification devices 106, 206 are also configured to be in electrical communication with the electrically conductive path through the indicators 100, 200. The notification devices 106, 206 are each configured to provide notification upon detection of a signal by the corresponding detection circuit 130, 230. In particular, the first in-line modular indicator 100 has a first notification device 106 configured to provide a first notification upon detection of the first signal by the first detection circuit 130. Further, the second in-line modular indicator 200 has a second notification device 206 configured to provide a second notification upon detection of the second signal by the second detection circuit 230. The fact that the notifications by the notification components 132, 232 are different may advantageously allow a user to distinguish the notifications and attribute a particular notification to corresponding operating conditions.

In the current example, the first notification device 106 has an illumination component 132 and, in particular, a plurality of illumination components. The illumination components 132 can be, for example, one or more light emitting diodes (LED). The illumination component 132 can be configured to illuminate a particular color in response to the first detection circuit 130 detecting a first signal. In the current example, illumination components 132 are disposed on opposite surfaces of the first detection circuit 130. Illumination is emitted outward from each side of the first detection circuit 130. In some embodiments where a plurality of illumination components 132 are employed and where the first detection circuit 130 is configured to detect different signals, the illumination components 132 can be different colors to provide notification of the detection of each signal.

Some embodiments of first notification device 106 can output more than one illumination pattern to indicate more than one signal condition detected. For example, when the first detection circuit 130 detects a certain signal amplitude below a first threshold, the first notification device 106 may flash at 1 Hz, and when the first detection circuit 130 detects the certain signal amplitude below a second threshold, the first notification device 106 may flash at 2.5 Hz, and/or in a different color. By way of example and not limitation, the illumination output may be coded or modulated by time (e.g., repetition rate, period, frequency, duty cycle, off time), amplitude (e.g., brightness), color (e.g., selected colors correspond to predetermined scenarios), or phase (e.g., sequencing, spacing of alternating flashing color), for example.

The first notification device 106 also has a housing 105 about the illumination device that is configured to accommodate transmission of light from the illumination component 132. The housing 105 has a tubular shape and is constructed of a transparent or translucent material. The housing is generally hollow and can have a variety of configurations. While the housing 105 currently has a circular cross section in the direction perpendicular to the first axis 135, in some embodiments the housing defines a prism and, as such, has a polygonal cross section. In some embodiments the housing has an ovular cross section. In some embodiments the outer surface of the housing can define indentations, bulges, and/or flat portions. In various embodiments, the first notification device 106 is configured to emit light radially outward from the first axis 135 of the first in-line modular indicator 100. In various embodiments, the first notification device 106 is configured to emit light in substantially all radial directions with respect to the first axis 135.

The first notification device 106 can have a length N1 (FIG. 1) generally ranging from 5 mm to 150 mm. The length is generally measured along the first axis 135. In some embodiments the first notification device 106 can have a length N1 ranging from 20 mm to 100 mm. The first notification device 106 can have a first width dimension W1 (FIG. 1) that is generally less than 31 mm, where the first width dimension W1 is a maximum dimension across the first notification device 106 in an imaginary plane perpendicular to the first axis 135. In the current example, where the first notification device 106 has a circular cross-section, the first width dimension W1 is a maximum diameter of the first notification device 106. However, the first width dimension can be a maximum diagonal measurement where the cross section of the notification device 106 is polygonal. In some embodiments, the first width dimension W1 ranges from 5 mm to 30 mm. In various embodiments, the first width dimension W1 of the first notification device 106 is the maximum width dimension of the first in-line modular indicator.

Similarly, in the current example, the second notification device 206 has an illumination component 232 and, in particular, a plurality of illumination devices. The illumination component 232 can have, for example, one or more light emitting diodes (LED). The illumination component 232 can be configured to illuminate a particular color in response to the second detection device detecting a second signal. Similar to the first notification component 132, the second notification component 232 also has a housing 205 about the illumination device that is configured to accommodate transmission of light from the illumination component 232. The housing 205 has a tubular shape and is constructed of a transparent or translucent material. In various embodiments, the second notification device 206 is configured to emit light radially outward from a second axis 235 extending centrally through the second in-line modular indicator 200. The dimensions and configurations of the second notification device 206 can be consistent with the dimensions and configurations of the first notification device 106, discussed above.

The first notification device 106 and the second notification device 206 are configured to provide alternate notifications. The notification of the second notification device 206 will generally be different than the notification of the first notification device 106. In various embodiments, the color of the illumination of the first notification device 106 is different than the color of the illumination of the second notification device 206. For example, the first notification device 106 can be configured to illuminate green and the second notification device 206 can be configured to illuminate red, yellow, orange, or another color other than green. In some embodiments, the pattern of illumination of the first notification device 106 is different than the pattern of the illumination of the second notification device 206. For example, the first notification device 106 can illuminate with a steady brightness (as perceived by a human eye) and the second notification device 206 can flash on and off (as perceived by a human eye).

While the notification devices 106, 206 consistent with the current example are each illumination devices, other types of notification devices can also be employed. For example, a notification device can be an audio device that is configured to provide audible feedback to a user in response to the detection circuit detecting a particular signal. As another example, a notification device can be configured to provide haptic feedback such as a vibration in response to the detection circuit detecting a particular signal. In some embodiments the notification device can be configured to power an actuator in response to the detection circuit detecting a particular signal. The actuator can be configured to actuate operation of a device such as a vibration generator.

With respect to the first in-line modular indicator 100, the first releasable electrical interface 120 is configured to releasably couple to an electrical cable. The first releasable electrical interface 120 is configured to be in electrical communication with an electrical cable when coupled thereto. The first releasable electrical interface 120 and the first mating electrical interface 125 are generally configured to couple to an off-the-shelf electrical cable. Generally the first releasable electrical interface 120 is configured to couple to a male or female end of an electrical cable, and the first mating electrical interface 125 is configured to couple to the other of the male or female end of the electrical cable. As such, the first mating electrical interface 125 has a structure that is capable of mating with the first releasable electrical interface 120. However, in some embodiments, the first mating electrical interface 125 cannot actually be coupled to the first releasable electrical interface 120 because the indicator 100 does not have the flexibility to bring the interfaces 120, 125 into mating contact. Stated differently, although the first mating electrical interface 125 has a structure that may be capable of mating with the first releasable electrical interface 120, the first mating electrical interface 125 cannot actually be coupled to the first releasable electrical interface 120 without, for example, causing damage to the in-line modular indicator.

In the current example, the first in-line modular indicator 100 defines a first axis 135. The first releasable electrical interface 120 and the first mating electrical interface 125 are defined about the first axis 135. In various embodiments the first releasable electrical interface 120 is disposed at one axial end of the indicator 100 and the first mating electrical interface 125 is disposed at an opposite axial end of the indicator 100. The first releasable electrical interface 120 and the first mating electrical interface 125 are in electrical communication with the first detection circuit 130 and the first notification device 106. In particular, in the current example, the first releasable electrical interface 120 electrically connects to the first detection circuit 130 via terminal interface components 116, 117 (visible in FIG. 1). The first mating electrical interface 125 electrically connects to the first detection circuit 130 via terminal interface components 118, 119 (visible in FIG. 2).

The first releasable electrical interface 120 is generally configured to form a mechanical and electrical connection with a mating component such as an electrical cable or a second in-line modular indicator 200. The first releasable electrical interface 120 has a plurality of terminals 112 extending axially. The plurality of terminals 112 are generally configured to transmit electrical signals to and from the first in-line modular indicator 100. The plurality of terminals 112 are defined within an axial opening 114 formed by a first mechanical coupling structure 110. The first mechanical coupling structure 110 is generally configured to form a mechanical connection between the first releasable electrical interface 120 and a mating cable.

The first mechanical coupling structure 110 is an externally threaded tubular extension that surrounds the plurality of terminals 112. The first mechanical coupling structure 110 is generally configured to be rotatably received by a mating internally threaded interface of a corresponding cable connector such that the plurality of terminals 112 are received by corresponding channels of the cable connector. The first releasable electrical interface 120 is configured to be in electrical communication with the corresponding cable connector and releasably coupled to the corresponding cable connector. By way of example, the first releasable electrical interface 120 can be consistent with an M12-type or M8-type connector. In some other embodiments the first releasable electrical interface 120 can be consistent with a clasp-and-lock type interface instead of the screw-type interface. In some other embodiments, the first releasable electrical interface 120 can be consistent with industry standard fasteners may also be used, such as, for example, BNC, Deutsch, M23 or USB.

The first releasable electrical interface 120 can have a first mechanical connector dimension W3 of less that 30 mm, where the "first mechanical connector dimension" is defined herein as a maximum dimension of the first mechanical coupling structure 110 in a plane perpendicular to the first axis 135. In the example depicted, the first mechanical connector dimension W3 is the diameter of the first mechanical coupling structure 110. In some embodiments, the first mechanical connector dimension W3 is a width of a first mechanical coupling structure 110, such as where the first mechanical coupling structure 110 has a clasp-and-lock configuration. In some embodiments, the first mechanical coupling structure 110 has a first mechanical connector dimension W3 ranging from 4 mm to 26 mm. In some embodiments the first mechanical coupling structure 110 has a first mechanical connector dimension W3 ranging from 8 mm to 23 mm.

The first mating electrical interface 125 is generally configured to form a mechanical and electrical connection with a mating component such as an electrical cable or the second in-line modular indicator 200. The first mating electrical interface 125 is on the second end 104 of the first in-line modular indicator 100. The first mating electrical interface 125 has a plurality of terminal channels 127 extending axially towards the first end 102 of the indicator 100. The plurality of terminal channels 127 are generally configured to transmit electrical signals to and from the first in-line modular indicator 100. The plurality of terminal channels 127 are structured to receive the plurality of terminals 112 of the first releasable electrical interface 120. The plurality of terminal channels 127 are positioned centrally to a first mating coupling structure 129 of the first mating electrical interface 125.

In embodiments where the electrically conductive path through the detection circuit 130 is defined by a plurality of wires, each wire can extend from a terminal 112 to a corresponding terminal channel 127 such that each terminal 112 is in electrical communication with a corresponding terminal channel 127. Each wire can be a single continuous length of wire or can be a series of segments of wires in electrical communication. In various embodiments, at least a first wire of the plurality of wires is in electrical communication with the detection circuit 130. In such embodiments, at least one other wire of the plurality of wires electrically bypasses the detection circuit 130, where "electrically bypasses" means that the wire is not configured for electrical communication with the detection circuit. In some embodiments, each wire other than the first wire electrically bypasses the detection circuit 130.

The first mating coupling structure 129 is generally configured to form a mechanical connection between the first mating electrical interface 125 or a mating cable. In this example, the first mating coupling structure 129 is an internally threaded region defined by a tubular extension 115 that surrounds the plurality of terminal channels 127. An annular gap 128 is defined between the internally threaded extension 115 and a cylindrical component 126 defining the terminal channels 127. The annular gap 128 is sized to receive externally threaded tubular extension that is the first mechanical coupling structure 110 to bring terminals and terminal channels into electrical communication. The first mating coupling structure 129 is configured to be rotatably received by a mating externally threaded interface of a corresponding cable connector such that the plurality of terminal channels 127 receive a plurality of terminals of the cable connector. In various embodiments, the first mating coupling structure 129 is rotatably disposed on the second end 104 of the first in-line modular indicator 100.

Consistent with the first releasable electrical interface 120, the first mating electrical interface 125 can be consistent with an M12-type or M8-type connector. In some other embodiments the first mating electrical interface 125 can be consistent with a clasp-and-lock type interface instead of the screw-type interface. In some other embodiments, the first mating electrical interface 125 can be consistent with industry standard fasteners may also be used, such as, for example, BNC, Deutsch, M23 or USB fasteners.

The first mating coupling structure 129 can have a second mechanical connector dimension W2 (FIG. 2) of less that 30 mm, where the "second mechanical connector dimension" is defined herein as a maximum dimension across the first mating coupling structure 129 in a plane perpendicular to the first axis 135. In the example depicted, the second mechanical connector dimension W2 is the outer diameter of the first mating coupling structure 129. In some embodiments, the second mechanical connector dimension W2 is a diagonal of a first mating coupling structure 129, such as where the first mating coupling structure 129 has a clasp-and-lock configuration. In some embodiments, the first mating electrical interface 125 has a second mechanical connector dimension W2 ranging from 4 mm to 26 mm. In some embodiments the first mating coupling structure 129 has a first mechanical connector dimension W2 ranging from 8 mm to 23 mm. In various embodiments, the second mechanical connector dimension W2 is greater than the first mechanical connector dimension W3. In some embodiments, the second mechanical connector dimension W2 is equal to the maximum width dimension of the first in-line modular indicator 100. In some embodiments, the second mechanical connector dimension W2 is less than the first width dimension of the first notification device 106.

The first mating electrical interface 125 can have a first mechanical connector dimension D1 of less that 30 mm, where the "first mating connector dimension" is defined herein as a maximum dimension of the first mechanical coupling structure 110 in a plane perpendicular to the first axis 135. In the example depicted, the first mating connector dimension D1 is the diameter of the first mating coupling structure 129. In some embodiments, the first mating electrical interface 125 has a first mating connector dimension D1 ranging from 4 mm to 26 mm. In some embodiments the first mating electrical interface 125 has a first mating connector dimension D1 ranging from 8 mm to 23 mm.

With respect to the second in-line modular indicator 200, the second releasable electrical interface 220 and the second mating electrical interface 225 are configured similarly to the first releasable electrical interface 120 and the first mating electrical interface 125, respectively. As such, the descriptions of the first releasable electrical interface 120 and the first mating electrical interface 125 applies here to the second releasable electrical interface 220 and the second mating electrical interface 225. In various embodiments, the second releasable electrical interface 220 is identical to the first releasable electrical interface 120. In various embodiments, the second mating electrical interface 225 is substantially identical to the first mating electrical interface 125. For example, the second mating electrical interface 225 similarly has a second mating coupling structure having an internally threaded region (not currently visible) defined by a tubular extension 215 that surrounds a plurality of terminal channels.

In the current example, the second in-line modular indicator 200 defines the second axis 235. The second releasable electrical interface 220 and the second mating electrical interface 225 are defined about the second axis 235. A second electrically conductive path extends from the second releasable electrical interface 220 to the second mating electrical interface 225. In particular, the second releasable electrical interface 220 and the second mating electrical interface 225 are in electrical communication with the second detection circuit 230 and the second notification device 206. More particularly, in the current example, the second releasable electrical interface 220 electrically connects to the second detection circuit 230 via terminal interface components 216, 217 (visible in FIG. 1). Further, the second mating electrical interface 225 electrically connects to the second detection circuit 230 via terminal interface components 218, 219 (visible in FIG. 2).

The second releasable electrical interface 220 is configured to electrically and mechanically couple to the first mating electrical interface 125. The first releasable electrical interface 120 is configured to electrically and mechanically couple to the second mating electrical interface 225. The first axis 135 and the second axis 235 are configured to be colinear when the first in-line modular indicator and the second in-line modular indicator 200 are coupled.

The second releasable electrical interface 220 is configured to releasably couple to the first mating electrical interface 125. The second releasable electrical interface 220 has a plurality of terminals 212 extending axially that are configured to be received by the terminal channels 127 defined by the first mating electrical interface 125. The plurality of terminals 212 are generally configured to transmit electrical signals to and from the second in-line modular indicator 200. The plurality of terminals 212 are defined within an axial opening 214 formed by a second mechanical coupling structure 210. The second mechanical coupling structure 210 is generally configured to form a mechanical connection between the second releasable electrical interface 220 and the first mating electrical interface 125. In particular, the second mechanical coupling structure 210 is an externally threaded tubular extension that surrounds the plurality of terminals 212 that is configured to be received by the internally threaded region of the first mating coupling structure 129.

Similar to the first indicator 100, in embodiments where the electrically conductive path through the detection circuit 230 is defined by a plurality of wires, each wire can extend from a terminal 212 to a corresponding terminal channel (not currently visible, but similar in structure to the first terminal channel 127) such that each terminal 212 is in electrical communication with a corresponding terminal channel. In various embodiments, at least a second wire of the plurality of wires is in electrical communication with the detection circuit 230. In such embodiments, at least one other wire of the plurality of wires electrically bypasses the detection circuit 230. In some embodiments, each wire other than the second wire electrically bypasses the detection circuit 230.

While not clearly visible in the current figures, the second mating electrical interface 225 is generally identical to the first mating electrical interface 125. The second mating electrical interface 225 is configured to releasably couple with the first releasable electrical interface 120.

Figure 3:
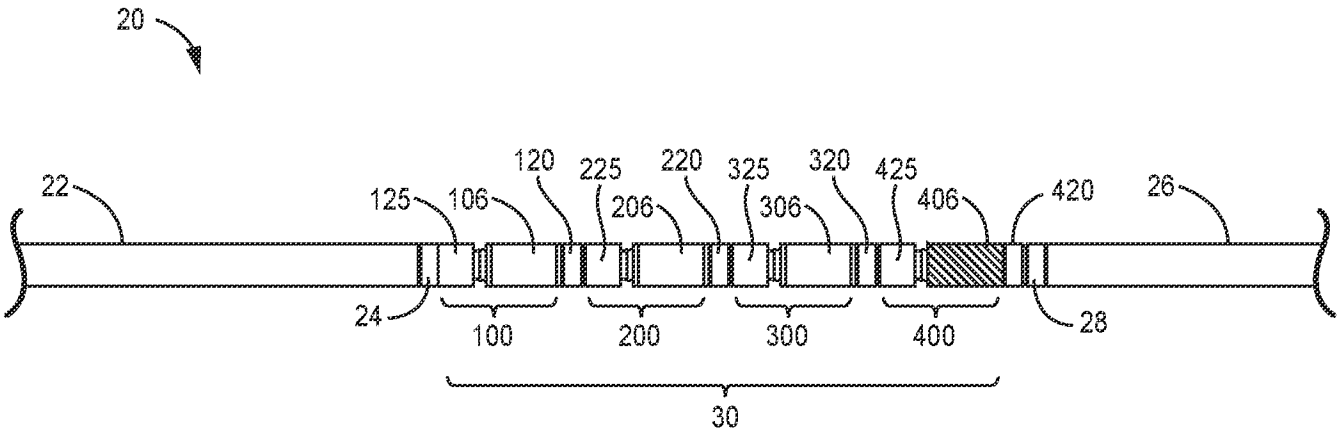
FIG. 3 is an example implementation of an in-line indicator assembly consistent with some implementations.

FIG. 3 is an example assembly 20 consistent with various implementations of the current technology. A first electrical cable 22 and a second electrical cable 26 are configured to be coupled in a series with a plurality of in-line modular indicators 30. The in-line modular indicators 30 are each consistent with the technology disclosed herein. Each of the plurality of in-line modular indicators 30 are configured to be in electrical communication with the first electrical cable 22 and the second electrical cable 26. The plurality of in-line modular indicators 30 are configured to define an electrically conductive path to transmit electricity from the first electrical cable 22 to the second electrical cable 26.

Each in-line modular indicator 100, 200, 300, 400 of the plurality of in-line modular indicators 30 has a releasable electrical interface 120, 220, 320, 420 and a mating electrical interface 125, 225, 325, 425. Each mating electrical interface is structured to releasably couple to each releasable electrical interface. The releasable electrical interfaces and the mating electrical interfaces can be consistent with the discussions of those components above. Similarly, the first electrical cable 22 has a releasable electrical interface 24 that is configured to releasably couple to each mating electrical interface 125, 225, 325, 425. In the currently depicted implementation, the releasable electrical interface 24 is releasably coupled to a first mating electrical interface 125 of a first in-line modular indicator 100. The second electrical cable 26 has a mating electrical interface 28 that is configured to releasably couple to each releasable electrical interface 120, 220, 320, 420. In the currently depicted implementation, the mating electrical interface 28 is releasably coupled to a fourth releasable electrical interface 420 of a fourth in-line modular indicator 400.

Each in-line modular indicator 100, 200, 300, 400 has a notification device 106, 206, 306, 406. The notification devices are configured to provide different notifications. In the current example, at least one in-line modular indicator 400 of the plurality of in-line modular indicators 30 has a notification device that is an audio device 406. At least one in-line modular indicator 100, 200, 300 of the plurality of in-line modular indicators 30 has a notification device 106, 206, 306 that is an illumination device. Each illumination device can be configured to emit light radially from a central axis of its corresponding in-line modular indicator 100, 200, 300, as has been discussed above. Each illumination device can be configured to emit a different color light. For example, a first notification device 106 can be configured to illuminate a first color, a second notification device 206 can be configured to illuminate a second color, and a third notification device 306 can be configured to illuminate a third color.

Figure 4:
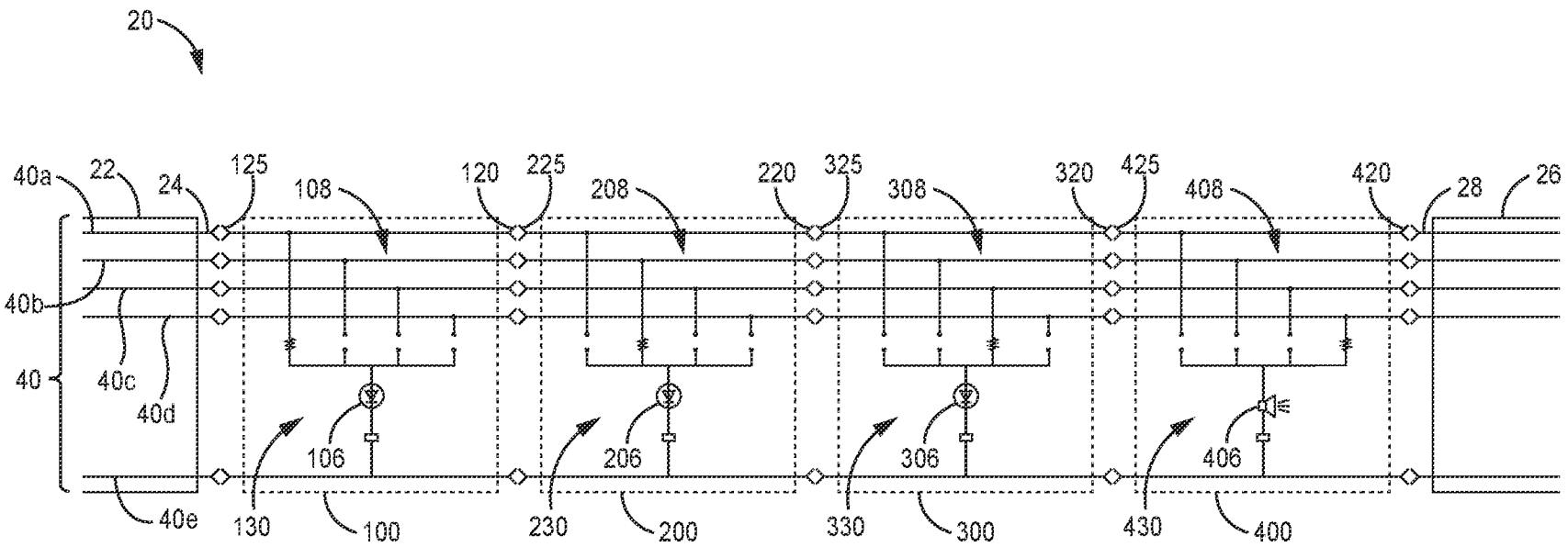
FIG. 4 is a simplified schematic view of a circuit diagram of the example implementation of FIG. 3.

FIG. 4 is a simplified schematic representation of a circuit diagram consistent with the assembly 20 of FIG. 3. Each in-line modular indicator 100, 200, 300, 400 defines an electrically conductive path 108, 208, 308, 408 from the releasable electrical interface 120, 220, 320, 420 and the mating electrical interface 125, 225, 325, 425. The electrically conductive paths are in electrical communication with each other and with the first electrical cable 22 and the second electrical cable 26. In particular, the assembly 20 defines an assembly electrically conductive path 40 extending among the first electrical cable 22, each of the in-line modular indicators, and the second electrical cable 26.

Each in-line modular indicator 100, 200, 300, 400 has a detection circuit 130, 230, 330, 430 that is in communication with the assembly electrically conductive path 40 and the electrically conductive path 108, 208, 308, 408 within the indicator. Furthermore, each in-line modular indicator 100, 200, 300, 400 has a notification device 106, 206, 306, 406 that is in communication with the assembly electrically conductive path 40. Each detection circuit 130, 230, 330, 430 is in electrical communication with the corresponding notification device 106, 206, 306, 406 in the respective in-line modular indicator 100, 200, 300, 400.

The assembly electrically conductive path 40 can have a plurality of individuals pathways 40*a*, 40*b*, 40*c*, 40*d* and a ground pathway 40*e* that cumulatively define the assembly electrically conductive path 40. In this example, the first detection circuit 130 is in electrical communication with a first pathway 40*a* and is not in electrical communication with a second pathway 40*b*, third pathway 40*c*, or fourth pathway 40*d* of the assembly electrically conductive path 40. The second detection circuit 230 is in electrical communication with a second pathway 40*b* and is not in electrical communication with a first pathway 40*a*, third pathway 40*c*, or fourth pathway 40*d* of the assembly electrically conductive path 40, and so on. Each pathway 40*a*, 40*b*, 40*c*, 40*d* extends through the first electrical cable 22, each of the in-line modular indicators, the second electrical cable 26. Each pathway 40*a*, 40*b*, 40*c*, 40*d* extends from each releasable electrical interface 24, 120, 220, 320, 420 to a mating electrical interface 28, 125, 225, 325, 425.

In some embodiments, the electrically conductive path 108, 208, 308, 408 of each in-line modular indicator 100, 200, 300, 400 has a current carrying capacity that is at least equal to the current carrying capacity of the first electrical cable 22 and the second electrical cable 26. In some embodiments, each electrically conductive path 108, 208, 308, 408 has a current carrying capacity of up to 4A. In some embodiments, each electrically conductive path 108, 208, 308, 408 has a current carrying capacity from 1A to 4A. In various embodiments, each of the in-line modular indicators 100, 200, 300, 400 are configured to consume no more than 10% of the current carrying capacity of the electrically conductive path 108, 208, 308, 408. In some embodiments, each of the in-line modular indicators 100, 200, 300, 400 are configured to consume no more than 5% or no more than 3% of the current carrying capacity of the electrically conductive path 108, 208, 308, 408. As such, the in-line modular indicators 100, 200, 300, 400 are configured to pass through power between the first electrical cable 22 and the second electrical cable 26. Generally, each in-line modular indicator 100, 200, 300, 400 is rated to consume under 50 mA (milliamperes) of current. In some embodiments, each in-line modular indicator 100, 200, 300, 400 is rated to consume less than or equal to 30 mA of current. In some embodiments, each in-line modular indicator 100, 200, 300, 400 is rated to consume about 20 mA of current.

In various embodiments, a detection circuit may include a network module. The network module may provide a communication path between the in-line modular indicator and a mobile electrical device (e.g., tablet). For example, the network module may be wireless such that status indicator information may be transmitted, via a wireless network, to a mobile electrical device. A user may, from a remote location, monitor the status indicator information from the mobile electrical device.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the first receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using Omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Fire wire, ATA/IDE, RS-232, RS-422, RS-485, 802.11 a/b/g, Wi-Fi, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

Figure 5:
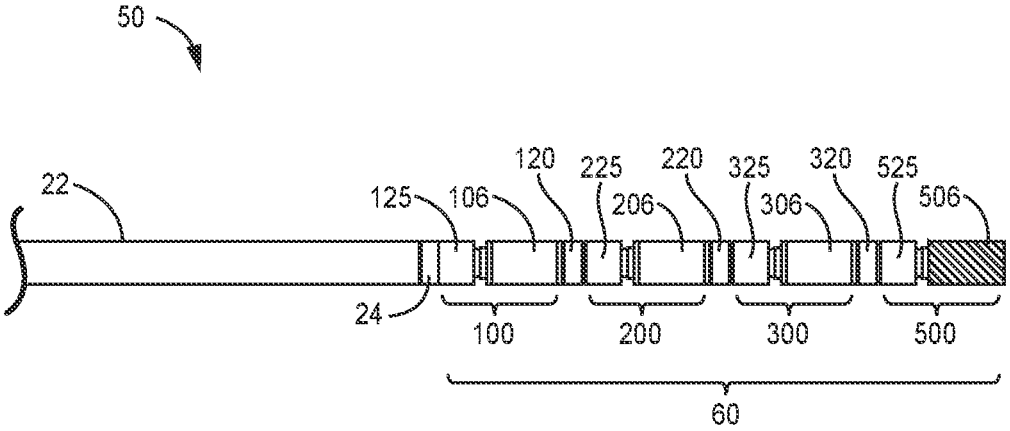
FIG. 5 is another example in-line indicator assembly consistent with embodiments.

FIG. 5 is another example assembly 50 consistent with various implementations of the current technology. A first electrical cable 22 is configured to be coupled in a series with a plurality of in-line modular indicators 60. A first, second, and third in-line modular indicators 100, 200, 300 are each consistent with the technology disclosed herein. In the current embodiment, however, a fourth in-line modular indicator 500 is incorporated in the assembly 50 that does not define an electrically conductive path extending therethrough.

Each of the first three in-line modular indicators 100, 200, 300 are configured to be in electrical communication with the first electrical cable 22 and a second electrical cable (not currently shown). The fourth indicator 500, however, is configured to be in electrical communication with the first electrical cable 22 and not a second electrical cable. The plurality of in-line modular indicators 60 are configured to define an electrically conductive path to transmit electricity from the first electrical cable 22 to the fourth indicator 500. Furthermore, each of the first three in-line modular indicators 100, 200, 300 have a releasable electrical interface 120, 220, 320 and a mating electrical interface 125, 225, 325 in electrical communication with the first electrical cable 22, but the fourth in-line modular indicator 500 has a mating electrical interface 525 only. It should be understood that in some other embodiments, the fourth in-line modular indicator has a releasable electrical interface and omits the mating electrical interface.

In the current example, the fourth in-line modular indicator 500 has a notification device 506 that can be consistent with notification devices described herein. The notification device 506 can be an audio device.

It should also be noted that, as used in this specification and the appended claims, the phrase "configured" describes a system, apparatus, or other structure that is constructed to perform a particular task or adopt a particular configuration. The word "configured" can be used interchangeably with similar words such as "arranged", "constructed", "manufactured", and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference. In the event that any inconsistency exists between the disclosure of the present application and the disclosure(s) of any document incorporated herein by reference, the disclosure of the present application shall govern.

This application is intended to cover adaptations or variations of the present subject matter. It is to be understood that the above description is intended to be illustrative, and not restrictive, and the claims are not limited to the illustrative embodiments as set forth herein.

What is claimed is:

1. An in-line modular indicator assembly comprising:

a first in-line modular indicator comprising:

a first releasable electrical interface configured to releasably couple to an electrical cable;

a first mating electrical interface having a structure capable of mating with the first releasable electrical interface;

a first electrically conductive path extending from the first releasable electrical interface to the first mating electrical interface;

a first detection circuit in electrical communication with the first electrically conductive path, wherein the first detection circuit is configured to detect a first signal; and a first notification device configured to provide a first notification upon detection of the first signal; and a second in-line modular indicator comprising:

a second releasable electrical interface, wherein the second releasable electrical interface is configured to releasably couple to the first mating electrical interface;

a second mating electrical interface, wherein the second mating electrical interface is configured to releasably couple with the first releasable electrical interface;

a second electrically conductive path extending from the second releasable electrical interface to the second mating electrical interface;

a second detection circuit in electrical communication with the second electrically conductive path, wherein the second detection circuit is configured to detect a second signal that is different than the first signal; and a second notification device configured to provide a second notification upon detection of the second signal, wherein the second notification is different from the first notification.

2. The in-line modular indicator assembly of claim 1, wherein the first notification device is an audio device.

3. The in-line modular indicator assembly of claim 1, wherein the first releasable electrical interface has a first connector dimension of less than 30 mm.

4. The in-line modular indicator assembly of claim 1, wherein the first releasable electrical interface has a first connector dimension ranging from 4 mm to 26 mm.

5. The in-line modular indicator assembly of claim 1, wherein the first notification device is a first illumination device configured to illuminate a first color and the second notification device is a second illumination device configured to illuminate a second color.

6. The in-line modular indicator assembly of claim 1, wherein the first notification and the second notification device have a length ranging from 5 mm to 150 mm.

7. The in-line modular indicator assembly of claim 1, wherein the first notification and the second notification device have a maximum width dimension ranging from 5 mm to 30 mm.

8. The in-line modular indicator assembly of claim 1, wherein the first notification device is an illumination device.

9. The in-line modular indicator assembly of claim 8, wherein the illumination device is configured to emit light radially from a central axis of the first in-line modular indicator.

10. An in-line modular indicator assembly comprising:

a plurality of in-line modular indicators each configured to be coupled in a series with a first electrical cable and a second electrical cable, wherein the plurality of in-line modular indicators are configured to define an electrically conductive path to transmit electricity from the first electrical cable to the second electrical cable, and wherein each of the in-line modular indicators comprises:

a releasable electrical interface;

a mating electrical interface structured to releasably couple to the releasable electrical interface;

detection circuits having alternate configurations; and notification devices configured to provide alternate notifications.

11. The in-line modular indicator assembly of claim 10, wherein at least one in-line modular indicator of the plurality of in-line modular indicators comprises an audio device.

12. The in-line modular indicator assembly of claim 10, wherein each releasable electrical interface has a mechanical connector dimension of less than 30 mm.

13. The in-line modular indicator assembly of claim 10, wherein each releasable electrical interface has a mechanical connector dimension ranging from 4 mm to 26 mm.

14. The in-line modular indicator assembly of claim 10, wherein the notification devices comprise a first notification device comprising a first illumination device configured to illuminate a first color and a second notification device comprising a second illumination device configured to illuminate a second color.

15. The in-line modular indicator assembly of claim 10, wherein the notification devices each have a length ranging from 5 mm to 150 mm.

16. The in-line modular indicator assembly of claim 10, wherein the notification devices each have a maximum width dimension ranging from 5 mm to 30 mm.

17. The in-line modular indicator assembly of claim 10, wherein at least one in-line modular indicator of the plurality of in-line modular indicators is an illumination device.

18. The in-line modular indicator assembly of claim 17, wherein the illumination device is configured to emit light radially from a central axis of the at least one in-line modular indicator.

* * * * *